US008734210B2

(12) United States Patent
Burdett et al.

(10) Patent No.: US 8,734,210 B2
(45) Date of Patent: May 27, 2014

(54) AUTONOMOUS VENTILATION SYSTEM

(75) Inventors: Michael P. Burdett, Tucson, AZ (US); Daniel Reich, Tucson, AZ (US)

(73) Assignee: Oy Halton Group Ltd., Helsinki (FI)

( * ) Notice: Subject to any disclaimer, the term of this patent is extended or adjusted under 35 U.S.C. 154(b) by 46 days.

(21) Appl. No.: 13/182,304

(22) Filed: Jul. 13, 2011

(65) Prior Publication Data

US 2011/0269386 A1 Nov. 3, 2011

Related U.S. Application Data

(63) Continuation of application No. 12/050,473, filed on Mar. 18, 2008, now abandoned.

(60) Provisional application No. 60/915,974, filed on May 4, 2007.

(51) Int. Cl.
*F24C 15/20* (2006.01)

(52) U.S. Cl.
USPC .... 454/61; 126/299 R; 126/299 D; 126/299 F

(58) Field of Classification Search
USPC ..... 454/61; 126/299 R, 299 C–299 F
See application file for complete search history.

(56) References Cited

U.S. PATENT DOCUMENTS

| | | | |
|---|---|---|---|
| 2,743,529 | A | 5/1956 | Hayes |
| 2,833,615 | A | 5/1958 | Kollgaard |
| 2,853,367 | A | 9/1958 | Karol |
| 2,862,095 | A | 11/1958 | Scofield |
| 2,933,080 | A | 4/1960 | Adey |
| 3,045,705 | A | 7/1962 | Hausammann |
| 3,323,439 | A | 6/1967 | Waever et al. |
| 3,332,676 | A | 7/1967 | Namy |
| 3,381,134 | A | 4/1968 | Wolf |
| 3,400,649 | A | 9/1968 | Jensen |
| 3,457,850 | A | 7/1969 | Sweet et al. |

(Continued)

FOREIGN PATENT DOCUMENTS

| | | |
|---|---|---|
| AU | 1138776 | 9/1977 |
| AU | 3400697 | 1/1998 |

(Continued)

OTHER PUBLICATIONS

Abstract for Gidaspow, D. "Multiphase Flow and Fluidization-Continuum and Kinetic Theory Descriptions", Academic Press 1994.

(Continued)

*Primary Examiner* — Steven B McAllister
*Assistant Examiner* — Frances H Kamps
(74) *Attorney, Agent, or Firm* — Miles & Stockbridge P.C.; Mark A. Catan

(57) ABSTRACT

An autonomous ventilation system includes a variable-speed exhaust fan, a controller, an exhaust hood, and a spillage sensor. The exhaust fan removes air contaminants from an area. The controller is coupled to the exhaust fan and adjusts the speed of the exhaust fan. The exhaust hood is coupled to the exhaust fan and directs air contaminants to the exhaust fan. The spillage sensor is coupled to the controller, detects changes in an environmental parameter in a spillage zone adjacent to the exhaust hood, and communicates information relating to detected changes in the environmental parameter to the controller. The controller adjusts the speed of the exhaust fan in response to information relating to detected changes in the environmental parameter.

16 Claims, 5 Drawing Sheets

(56) References Cited

U.S. PATENT DOCUMENTS 3,513,766 A 5/1970 Alhrich
3,536,457 A 10/1970 Henderson
3,612,106 A 10/1971 Camboulives et al.
3,690,245 A 9/1972 Ferlise et al.
3,752,056 A 8/1973 Chamberlin et al.
3,809,480 A 5/1974 Somerville et al.
3,825,346 A 7/1974 Rizzo
3,829,285 A 8/1974 Beck
3,866,055 A 2/1975 Pike
3,895,569 A 7/1975 Miller
3,943,836 A 3/1976 Kuechler
3,952,640 A 4/1976 Kuechler
3,978,777 A 9/1976 Nett
4,043,319 A 8/1977 Jensen
4,047,519 A 9/1977 Nett
4,050,368 A 9/1977 Eakes
4,056,877 A 11/1977 Kuechler
4,085,736 A 4/1978 Kuechler
4,105,015 A 8/1978 Isom
4,109,641 A 8/1978 Hunzicker
4,113,439 A 9/1978 Ookubo
4,117,833 A 10/1978 Mueller
4,127,106 A 11/1978 Jensen
4,134,394 A 1/1979 Otenbaker
4,138,220 A 2/1979 Davies
4,146,017 A 3/1979 Overton
4,147,502 A 4/1979 Milton
4,153,044 A 5/1979 Nett
4,155,348 A 5/1979 Ahlrich
4,160,407 A 7/1979 Duym
4,211,154 A 7/1980 Eakes
4,213,947 A 7/1980 Fremont
4,285,390 A 8/1981 Fortune et al.
4,286,572 A 9/1981 Searcy
4,287,405 A 9/1981 Ohmae et al.
4,346,692 A 8/1982 Mccauley
4,350,166 A 9/1982 Mobarry
4,373,507 A 2/1983 Schwartz
4,398,415 A 8/1983 Jacocks et al.
4,467,782 A 8/1984 Russel
4,475,534 A 10/1984 Moriarty
4,483,316 A 11/1984 Fritz
4,484,563 A 11/1984 Fritz et al.
4,497,242 A 2/1985 Moyer
4,556,046 A 12/1985 Riffel et al.
4,584,929 A 4/1986 Jarmyer et al.
4,586,486 A 5/1986 Kaufman
4,617,909 A 10/1986 Molitor
4,655,194 A 4/1987 Wooden
4,706,553 A 11/1987 Sharp et al.
4,773,311 A 9/1988 Sharp
4,781,460 A 11/1988 Bott
4,788,905 A 12/1988 Von Kohorn
4,811,724 A 3/1989 Aalto
4,856,419 A 8/1989 Imai
4,867,106 A * 9/1989 Staats ..... 122/14.22
4,872,892 A 10/1989 Vartiainen et al.
4,903,685 A * 2/1990 Melink ..... 126/299 D
4,903,894 A 2/1990 Pellinen et al.
4,921,509 A 5/1990 Maclin
4,934,256 A 6/1990 Moss et al.
4,944,283 A 7/1990 Tsuchiya
4,944,285 A 7/1990 Glassman
5,042,453 A 8/1991 Shellenberger
5,042,456 A 8/1991 Cote
5,050,581 A 9/1991 Roehl-Hager et al.
5,063,834 A 11/1991 Aalto et al.
5,090,303 A 2/1992 Ahmed
5,092,227 A 3/1992 Ahmed et al.
5,115,728 A 5/1992 Ahmed et al.
5,139,009 A 8/1992 Walsh
5,146,284 A 9/1992 Tabarelli et al.
5,205,783 A 4/1993 Dieckert et al.
5,215,075 A 6/1993 Caridis
5,215,497 A 6/1993 Drees
5,220,910 A 6/1993 Aalto
5,240,455 A 8/1993 Sharp
5,251,608 A 10/1993 Cote
5,268,739 A 12/1993 Martinelli et al.
RE34,534 E * 2/1994 Staats ..... 122/13.1
5,311,930 A 5/1994 Bruenn
5,312,296 A 5/1994 Aalto
5,312,297 A 5/1994 Dieckert et al.
5,394,861 A 3/1995 Stegmaier
5,406,073 A 4/1995 Sharp et al.
5,414,509 A 5/1995 Veligdan
5,415,583 A 5/1995 Brandt, Jr.
5,518,446 A 5/1996 Jacob
5,522,377 A 6/1996 Fritz
5,558,821 A 9/1996 Konig
5,580,535 A 12/1996 Hoke
5,597,354 A 1/1997 Janu et al.
5,622,100 A 4/1997 King
5,657,744 A 8/1997 Vianen
5,713,346 A 2/1998 Kuechler
5,716,268 A 2/1998 Strongin
5,718,219 A 2/1998 Boudreault
5,720,274 A 2/1998 Brunner et al.
5,764,579 A 6/1998 McMasters et al.
5,779,538 A 7/1998 Jardinier
5,874,292 A 2/1999 McMinn, Jr.
5,882,254 A 3/1999 Jacob
5,960,786 A 10/1999 Lambertson
5,992,152 A 11/1999 Weres et al.
6,044,838 A 4/2000 Deng
6,058,929 A 5/2000 Fritz
6,089,970 A 7/2000 Feustel
6,154,686 A * 11/2000 Hefferen et al. ..... 700/276
6,170,480 B1 * 1/2001 Melink et al. ..... 126/299 R
6,171,480 B1 1/2001 Lee et al.
6,173,710 B1 1/2001 Gibson et al.
6,179,763 B1 1/2001 Phillips, III
6,252,689 B1 6/2001 Sharp
6,336,451 B1 1/2002 Rohl-Hager et al.
6,347,626 B1 2/2002 Yi
6,351,999 B1 3/2002 Maul et al.
6,428,408 B1 8/2002 Bell et al.
6,450,879 B1 9/2002 Suen
6,515,283 B1 2/2003 Castleman et al.
6,549,554 B2 4/2003 Shiojima et al.
6,645,066 B2 11/2003 Gutta et al.
6,669,547 B2 12/2003 Liu
6,752,144 B1 6/2004 Lee
6,782,294 B2 8/2004 Reich et al.
6,846,236 B2 1/2005 Gregoricka
6,851,421 B2 2/2005 Livchak et al.
6,869,468 B2 3/2005 Gibson
6,878,195 B2 4/2005 Gibson
6,890,252 B2 5/2005 Liu
6,899,095 B2 5/2005 Livchak
6,916,239 B2 7/2005 Siddaramanna et al.
6,920,874 B1 7/2005 Siegel
6,974,380 B2 12/2005 Cui et al.
7,048,199 B2 * 5/2006 Melink ..... 236/49.3
7,147,168 B1 12/2006 Bagwell et al.
7,258,280 B2 8/2007 Wolfson
7,318,771 B2 1/2008 Huang et al.
7,364,094 B2 * 4/2008 Bagwell et al. ..... 236/49.3
7,442,119 B2 10/2008 Fluhrer
7,699,051 B2 * 4/2010 Gagas et al. ..... 126/299 D
7,866,312 B2 * 1/2011 Erdmann ..... 126/299 D
8,038,515 B2 * 10/2011 Livchak et al. ..... 454/67
2003/0104778 A1 6/2003 Liu
2003/0146082 A1 8/2003 Gibson et al.
2003/0207662 A1 11/2003 Liu
2003/0210340 A1 11/2003 Romanowich
2003/0216837 A1 * 11/2003 Reich et al. ..... 700/276
2004/0011349 A1 1/2004 Livchak et al.
2005/0115557 A1 6/2005 Meredith
2005/0229922 A1 10/2005 Magner et al.
2005/0279845 A1 * 12/2005 Bagwell et al. ..... 236/49.4
2006/0009147 A1 1/2006 Huang et al.
2006/0032492 A1 * 2/2006 Bagwell et al. ..... 126/299 R
2006/0060187 A1 3/2006 Luddy et al.

(56) References Cited

U.S. PATENT DOCUMENTS

| | | | | |
|---|---|---|---|---|
| 2006/0219235 | A1 | 10/2006 | Bagwell et al. | |
| 2007/0015449 | A1 | 1/2007 | Livchak et al. | |
| 2007/0023349 | A1 | 2/2007 | Kyllonen et al. | |
| 2007/0068509 | A1 * | 3/2007 | Bagwell et al. | 126/299 D |
| 2007/0165353 | A1 | 7/2007 | Fleischer | |
| 2007/0183154 | A1 | 8/2007 | Robson | |
| 2007/0184771 | A1 | 8/2007 | Fluhrer | |
| 2007/0202791 | A1 | 8/2007 | Lee et al. | |
| 2007/0272230 | A9 | 11/2007 | Meredith et al. | |
| 2008/0045132 | A1 | 2/2008 | Livchak et al. | |
| 2008/0141996 | A1 | 6/2008 | Erdmann | |
| 2008/0207109 | A1 | 8/2008 | Bagwell | |
| 2008/0302247 | A1 | 12/2008 | Magner | |
| 2008/0308088 | A1 | 12/2008 | Livchak | |
| 2009/0032011 | A1 | 2/2009 | Livchak et al. | |
| 2009/0093210 | A1 | 4/2009 | Livchak | |
| 2009/0199844 | A1 | 8/2009 | Meredith | |
| 2011/0275301 | A1 | 11/2011 | Burdett et al. | |

FOREIGN PATENT DOCUMENTS

| | | |
|---|---|---|
| AU | 2933601 | 7/2001 |
| BE | 838829 | 6/1976 |
| CA | 1054430 | 5/1979 |
| CA | 1069749 | 1/1980 |
| CA | 1081030 | 7/1980 |
| CA | 2536332 | 3/2005 |
| CH | 682512 | 9/1993 |
| DE | 314477 | 9/1919 |
| DE | 2607301 | 9/1976 |
| DE | 2659736 | 7/1977 |
| DE | 3519189 | 12/1986 |
| DE | 4120175 | 2/1992 |
| DE | 4114329 | 11/1992 |
| DE | 4203916 | 4/1993 |
| DE | 19613513 | 10/1997 |
| EP | 0314085 | 5/1989 |
| EP | 0401583 | 12/1990 |
| EP | 0541862 | 5/1993 |
| EP | 0541863 | 5/1993 |
| EP | 0623398 | 11/1994 |
| EP | 0753706 | 1/1997 |
| EP | 0881935 | 12/1998 |
| EP | 1250556 | 10/2002 |
| EP | 1637810 | 3/2006 |
| EP | 1778418 | 2/2007 |
| FI | 58971 | 1/1981 |
| FR | 2008451 | 1/1970 |
| FR | 2301778 | 9/1976 |
| FR | 2705766 | 2/1994 |
| GB | 1544445 | 4/1979 |
| GB | 2054143 | 2/1981 |
| GB | 2132335 | 7/1984 |
| GB | 2266340 | 10/1993 |
| HK | 1019417 | 2/2000 |
| JP | 51-132645 | 11/1976 |
| JP | 60-213753 | 10/1985 |
| JP | 63-091442 | 4/1988 |
| JP | 63-251741 | 10/1988 |
| JP | 10-084039 | 3/1989 |
| JP | 02-033552 | 2/1990 |
| JP | 32-047937 | 11/1991 |
| JP | 40-000140 | 1/1992 |
| JP | 40-062347 | 2/1992 |
| JP | 40-068242 | 3/1992 |
| JP | 41-013143 | 4/1992 |
| JP | 52-048645 | 9/1993 |
| JP | 10-288371 | 10/1998 |
| JP | H11-514734 | 12/1999 |
| JP | 2000-081216 | 3/2000 |
| JP | 2002-089859 | 3/2002 |
| JP | 2003-519771 | 6/2003 |
| JP | 2003-269770 | 9/2003 |
| NL | 7601862 | 2/1976 |
| SE | 7602168 | 8/1976 |
| SE | 7904443 | 11/1980 |
| WO | 86/06154 | 10/1986 |
| WO | 91/17803 | 11/1991 |
| WO | 92/08082 | 5/1992 |
| WO | 97/48479 | 12/1997 |
| WO | 01/51857 | 7/2001 |
| WO | 01/83125 | 11/2001 |
| WO | 01/84054 | 11/2001 |
| WO | 02/14728 | 2/2002 |
| WO | 02/14746 | 2/2002 |
| WO | 03/056252 | 7/2003 |
| WO | 2005/019736 | 3/2005 |
| WO | 2005/114059 | 12/2005 |
| WO | 2006/002190 | 1/2006 |
| WO | 2006/012628 | 2/2006 |
| WO | 2006/074420 | 7/2006 |
| WO | 2006/074425 | 7/2006 |
| WO | 2007/121461 | 10/2007 |
| WO | 2008/157418 | 12/2008 |
| WO | 2009/092077 | 7/2009 |
| WO | 2009/129539 | 10/2009 |

OTHER PUBLICATIONS

Abstract for Tennekes et al., "A First Course of Turbulence", Mass. Inst. Tech., 1972.

International Search Report and Written Opinion dated Jan. 5, 2007, for International Application No. PCT/US05/26378 filed Jul. 25, 2005.

Morsi et al., "An Investigation of Particle Trajectories in Two-Phase Flow Systems", *Journal of Fluid Mechanics*, 1972, 55: pp. 193-208.

Non-Final Office Action, dated May 28, 2010, in U.S. Appl. No. 12/407,686.

Prosecution history of U.S. Appl. No. 07/010,277, now U.S. Patent No. 4,811,724.

Saravelou et al., "Detailed Modeling of a Swirling Coal Flame", *Combustion Science and Technology*, 1997, 123: pp. 1-22.

Skimm, G.K., *Technician's Guide to HVAC*, 1995, McGraw-Hill, pp. 322-330.

Translation of foreign patent document DE 4203916.

* cited by examiner

AUTONOMOUS VENTILATION SYSTEM

CROSS REFERENCE TO RELATED APPLICATIONS

This application is a continuation of application Ser. No. 12/050,473 filed Mar. 18, 2008. This application also claims the benefit under 35 U.S.C. §119(e) of U.S. Provisional Application No. 60/915,974 filed May 4, 2007 entitled "Smart Kitchen Ventilation Hood." The entire content of each of the foregoing applications is hereby incorporated by reference into the present application.

TECHNICAL FIELD

This disclosure relates in general to control systems and more particularly to an autonomous ventilation system.

BACKGROUND

Ventilation systems are commonly found in modern residential, restaurant, and commercial kitchens. Heat, smoke, and fumes are an ordinary byproduct of cooking many foods and must be removed in order to protect the health and comfort of those present in the kitchen and adjacent areas. Ventilation systems provide an effective way to capture excessive heat, smoke, and fumes generated in kitchens and ventilate them to the atmosphere where they pose no threat to health or safety.

A typical ventilation system consists of an exhaust hood positioned over pieces of cooking equipment that are known to produce heat, smoke, or fumes. This exhaust hood is usually connected via ducts to an exhaust fan and in turn to a vent located on the outside of the building housing the kitchen. The exhaust fan is operated in a way to create a flow of air from the exhaust hood to the outside vent. This creates a suction effect at the exhaust hood that captures the air and any airborne contaminants around the hood. Consequently, any heat, smoke, or fumes generated by the cooking equipment will rise up to the overhead exhaust hood where it will be captured by the suction and transported out of the kitchen to the outside vent. There, it will dissipate harmlessly into the atmosphere.

Most ventilation systems must be manually activated and deactivated by the user. In a typical fast-food restaurant, for example, an employee must manually activate the kitchen ventilation system early in the day or before any cooking occurs. The system will then remain active in order to capture any smoke or fumes that may result from cooking. The system must then be manually deactivated periodically, at the end of the day, or after all cooking has ceased. This manual operation of the ventilation system typically results in the system being active at times when ventilation is not actually required. This needlessly wastes energy not only associated with the operation of the ventilation system, but also due to the ventilation of uncontaminated air supplied to the kitchen by a heating and cooling system. By operating when no smoke or fumes are present, the ventilation system will remove other valuable air that was supplied to heat or cool the kitchen and thus cause the heating and cooling system to operate longer than it would have otherwise.

SUMMARY OF THE DISCLOSURE

The present disclosure provides an autonomous ventilation system that substantially eliminates or reduces at least some of the disadvantages and problems associated with previous methods and systems.

According to one embodiment, an autonomous ventilation system includes a variable-speed exhaust fan, a controller, an exhaust hood, and a spillage sensor. The exhaust fan removes air contaminants from an area. The controller is coupled to the exhaust fan and adjusts the speed of the exhaust fan. The exhaust hood is coupled to the exhaust fan and directs air contaminants to the exhaust fan. The spillage sensor is coupled to the controller, detects changes in an environmental parameter in a spillage zone adjacent to the exhaust hood, and communicates information relating to detected changes in the environmental parameter to the controller. The controller adjusts the speed of the exhaust fan in response to information relating to changes in the environmental parameter detected by the spillage sensor.

Technical advantages of certain embodiments may include a reduction in energy consumption, an increase in the comfort of the ventilated area, a decrease in noise, and an increase in the lifespan of environmental sensors and fans. Embodiments may eliminate certain inefficiencies such as needlessly ventilating valuable air from an area that was supplied by a heating, ventilation, and air conditioning ("HVAC") system.

Other technical advantages will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present disclosure and its advantages, reference is now made to the following description, taken in conjunction with the accompanying drawings, in which.

DETAILED DESCRIPTION OF THE DISCLOSURE

Figure 1:
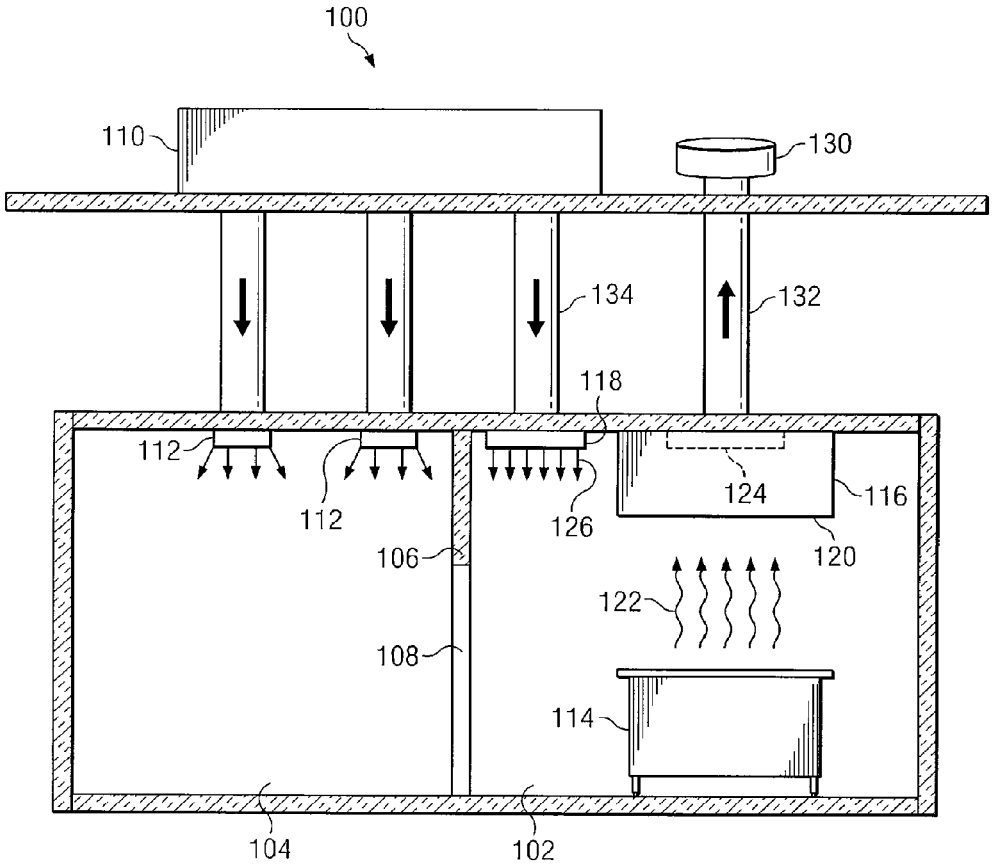
FIG. 1 is a simplified block diagram illustrating a facility requiring ventilation in accordance with a particular embodiment.

FIG. 1 depicts a facility 100 where a particular embodiment may be utilized. Facility 100 may be a restaurant, for example, that includes a kitchen 102 and at least one adjacent room 104 separated by a wall 106.

Wall 106 contains a doorway 108 that allows access between kitchen 102 and adjacent room 104. Facility 100 also includes an HVAC system 110 that provides conditioned air to the interior of facility 100 via interior vents 112. Kitchen 102 includes one or more pieces of cooking equipment 114, an exhaust hood 116, a ceiling supply air vent 118, and a ceiling exhaust vent 124. Examples of cooking equipment 114 include, but are not limited to, stoves, cooktops, ovens, fryers, and broilers. Exhaust hood 116 is oriented such that a downward-facing opening 120 is operable to direct an air contaminant 122 associated with the operation of cooking equipment 114 through ceiling exhaust vent 124 and ultimately out an exterior exhaust vent 130 via an exhaust duct 132. Air contaminant 122 includes, but is not limited to, smoke, steam, fumes, and/or heat. Ceiling supply air vent 118 is connected to a supply air duct 134 and is operable to provide supply air 126. Supply air 126 may be supplied from HVAC system 110 and may include conditioned air (i.e., heated or cooled air) or unconditioned air. Supply air 126 may be supplied in an amount corresponding to the amount of air removed from kitchen 102 via exhaust hood 116 such that the air pressure inside kitchen 102 remains relatively constant and positive in relation to outside pressure.

Removing air contaminants 122 from kitchen 102 helps ensure that kitchen 102, as well as adjacent room 104, remains safe, sufficiently free of air contaminants 122, and at a comfortable temperature for anyone inside. The volume of air exhausted via exhaust hood 116 should be carefully regulated to minimize the quantity of conditioned air (air entering facility 100 through HVAC system 110) that is vacated from kitchen 102 and facility 100 while ensuring that enough air is ventilated to prevent buildup of air contaminants 122. Because a particular piece of cooking equipment 114 may not be in use at all times and thus will not continuously generate air contaminants 122, it becomes beneficial to vary the rate at which exhaust hood 116 ventilates air contaminants 122 from kitchen 102 as well as the rate at which ceiling supply air vent 118 supplies air to kitchen 102 as a means to conserve energy and increase occupant safety and comfort. The embodiments discussed below provide a convenient alternative to manually activating a ventilation system as the level of air contaminants fluctuates.

While facility 100 has been described in reference to a restaurant, it should be noted that there are many facilities in need of such ventilation systems. Such facilities include manufacturing facilities, industrial facilities, residential kitchens, and the like. Likewise, embodiments in this disclosure are described in reference to kitchen 102, but could be utilized in any facility requiring ventilation.

Figure 2A:
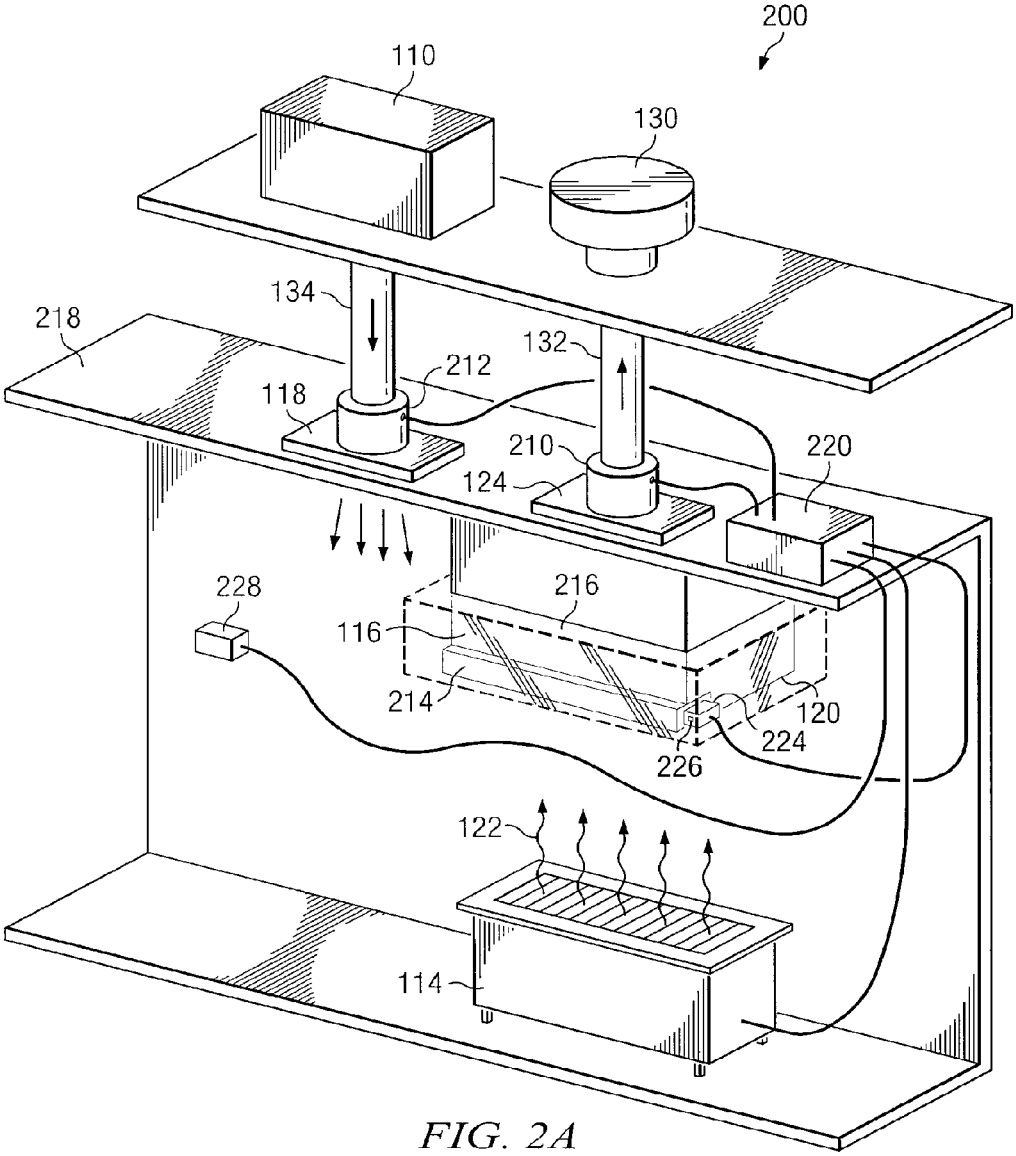
FIGS. 2A and 2B are simplified block diagrams illustrating a ventilation system in accordance with a particular embodiment.
Figure 2B:
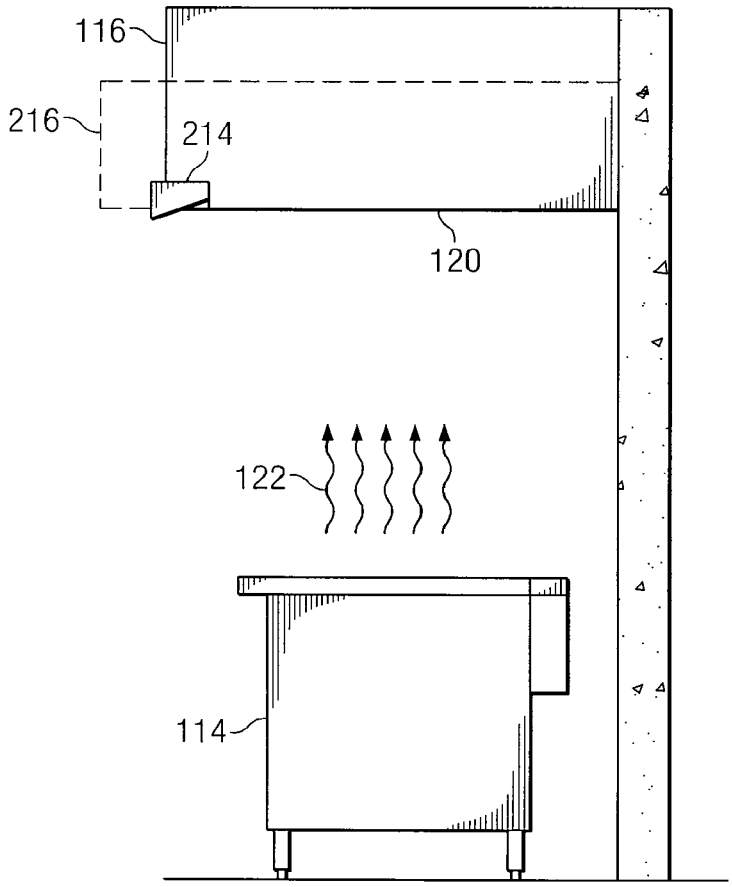

FIGS. 2A and 2B depict an autonomous ventilation system 200 as would be located inside kitchen 102 in accordance with a particular embodiment. Autonomous ventilation system 200 includes exhaust hood 116 with downward-facing opening 120. Exhaust hood 116 is coupled to ceiling exhaust vent 124 and is positioned above one or more pieces of cooking equipment 114. Air is drawn up through exhaust hood 116 via downward-facing opening 120 by an exhaust fan 210. Exhaust fan 210 may be positioned anywhere that allows it to draw air up through exhaust hood 116 including, but not limited to, inside exhaust hood 116 and exhaust duct 132. Autonomous ventilation system 200 also includes ceiling supply air vent 118 that can supply conditioned or unconditioned air to kitchen 102 from HVAC system 110. Air is supplied to kitchen 102 by a supply air fan 212 that is located in a position so as to create a flow of air through supply air duct 134 and ultimately out ceiling supply air vent 118.

Autonomous ventilation system 200 also includes a spillage probe assembly 214 containing one or more spillage sensors 230 (not pictured in FIGS. 2A or 2B) operable to measure environmental parameters in or about a spillage zone 216. Environmental parameters measured by spillage sensors 230 may include, but are not limited to, one or more of temperature, air flow, vapor presence, and/or fume presence. Spillage zone 216 envelops an area that is adjacent to exhaust hood 116 but is not directly beneath exhaust hood 116. If the ventilation rate of autonomous ventilation system 200 is insufficient to capture and remove all air contaminants 122 associated with the operation of cooking equipment 114, spillage air contaminants will spill out of exhaust hood 116 and pass upward through spillage zone 216. It should be noted that the dimensions of spillage zone 216 are just an example used for purposes of illustration and that spillage zone 216 may have different dimensions depending on the cooking environment.

Spillage probe assembly 214 also contains a termination box 224, and in some embodiments, an override button 226. The one or more spillage sensors 230 are coupled to termination box 224. In some embodiments, override button 226 is also coupled to termination box 224. Override button 226, however, may be located on spillage probe assembly 214, exhaust hood 116, or any other location that is accessible to a user.

Autonomous ventilation system 200 is controlled by a controller 220. As an example only, controller 220 may consist of the Kontar MC8 process controller manufactured by Current Energy, Inc. However, any suitable controller may be used. Controller 220 is coupled to exhaust fan 210, supply air fan 212, cooking equipment 114, an exhaust temperature sensor (not pictured), an ambient kitchen temperature sensor 228, override button 226, and/or one or more spillage sensors 230. Controller 220 receives information from spillage sensors 230 to determine fluctuations in an environmental parameter(s) in spillage zone 216. Controller 220 also communicates with exhaust fan 210 to control its speed and consequently the rate of ventilation of autonomous ventilation system 200. In some embodiments, controller 220 additionally communicates with supply air fan 212 to control its speed and thus the amount of air that is re-supplied to kitchen 102. Controller 220 may also be coupled to cooking equipment 114 in order to determine when it has been turned on and off.

In operation, autonomous ventilation system 200 automatically starts and stops according to a predetermined schedule and/or by sensing the activation of cooking equipment 114 under exhaust hood 116. In addition, the ventilation rate of autonomous ventilation system 200 automatically adjusts according to fluctuations in one or more environmental parameters in spillage zone 216 as sensed by spillage sensors 230. Additionally or alternatively, a user may manually control autonomous ventilation system 200 by momentarily pressing override button 226.

First, autonomous ventilation system 200 may automatically start and stop according to a predetermined schedule. A user may configure a schedule or modify an existing schedule through a local or remote interface to controller 220. Controller 220, in turn, may turn exhaust fan 210 on and off and/or adjust its speed based on this predetermined schedule. Additionally or alternatively, controller 220 may turn exhaust fan 210 on and off and/or adjust its speed based on the state of cooking equipment 114 under exhaust hood 116. In one embodiment, for example, controller 220 may be coupled to cooking equipment 114 in order to detect when it has been activated. In such an embodiment, controller 220 may turn on exhaust fan 210 when cooking equipment 114 has been activated, and may turn off exhaust fan 210 when cooking equipment 114 has been deactivated. By automatically starting and stopping according to a predetermined schedule and/or the state of cooking equipment 114, autonomous ventilation system 200 provides increased energy efficiency and comfort level while minimizing unnecessary noise and ventilation of conditioned air.

Additionally, controller 220 may turn exhaust fan 210 on and off and/or adjust its speed based on fluctuations in an environmental parameter in spillage zone 216 due to spillage air contaminants. In one embodiment, for example, spillage probe assembly 214 contains one or more spillage sensors 230 that measure the temperature of spillage zone 216. As an example only, spillage sensors 230 may consist of the Betatherm G10K3976AIG1 thermistor. In this embodiment, controller 220 may communicate with an ambient kitchen temperature sensor 228 to determine the ambient temperature of kitchen 102 away from the spillage zone (e.g., receive temperature measurements from sensors) and with spillage sensors 230 of spillage probe assembly 214 to determine the temperature of spillage zone 216. Controller 220 may then compare the temperature of spillage zone 216 with that of kitchen 102 to determine if the difference in temperature has reached or exceeded a predetermined amount, for example, two degrees Fahrenheit. If, for example, the temperature of spillage zone 216 exceeds the temperature of kitchen 102 by this predetermined amount (or any other suitable amount), controller 220 may accelerate the speed of exhaust fan 210 to increase the ventilation rate of autonomous ventilation system 200 and eliminate spillage air contaminants. Controller 220 may maintain this increased ventilation rate for a predetermined period of time or until it is determined that the increased rate is no longer needed. For example, controller 220 may decrease the speed or deactivate exhaust fan 210 when the difference in temperature between kitchen 102 and spillage zone 216 returns to a value that is less than the predetermined amount. By automatically adjusting its ventilation rate based on environmental parameters in spillage zone 216, autonomous ventilation system 200 alleviates disadvantages of other ventilation systems such as wasted energy and unnecessary noise. In addition, by locating spillage sensors 230 in spillage zone 216 outside of exhaust hood 116, the sensors are less susceptible to normal deterioration and corrosion caused by air contaminants 122. As a result, spillage sensors 230 require less cleaning and maintenance and will have a longer life.

In another embodiment, spillage probe assembly 214 may contain one or more spillage sensors 230 that measure bidirectional airflow through spillage zone 216. In this embodiment, spillage sensors 230 are orientated in such a way as to detect air flow in the up and down directions through spillage zone 216. If the ventilation rate of autonomous ventilation system 200 is insufficient to capture and remove all air contaminants 122 associated with the operation of cooking equipment 114, spillage air contaminants will spill out of exhaust hood 116 and pass through spillage zone 216 creating an upward flow of air. Controller 220 may detect this upward flow of air by receiving airflow measurements from spillage sensors 230. If the flow of air up through spillage zone 216 reaches or exceeds a predetermined amount, controller 220 may accelerate the speed of exhaust fan 210 to increase the ventilation rate of autonomous ventilation system 200 and eliminate or reduce spillage air contaminants. Controller 220 may then decrease the ventilation rate after a predetermined period of time or after it detects with spillage sensors 230 that there is no longer a flow of air up through spillage zone 216 equal to or greater than the predetermined amount.

In some embodiments, controller 220 may additionally or alternatively adjust the speed of exhaust fan 210 based on the state of override button 226. In this embodiment, a user may momentarily push override button 226 in order to manually control the speed of exhaust fan 210 and thus the ventilation rate of autonomous ventilation system 200. For example, if exhaust fan 210 is not on, a user may press override button 226 in order to activate autonomous ventilation system 200 for a predetermined amount of time. If exhaust fan 210 is already on, a user may press override button 226 in order to accelerate the ventilation rate of autonomous ventilation system 200 for a predetermined amount of time. In some embodiments, there may be more than one override button 226. In these embodiments, override buttons 226 may provide the user a means to turn autonomous ventilation system 200 on and/or off, increase and/or decrease the ventilation rate, or any combination of the proceeding. The one or more override buttons 226 provide the user with a means of manual control over autonomous ventilation system 200 when desired.

In some embodiments, controller 220 may also automatically control the speed of supply air fan 212 to provide a desired pressurization of kitchen 102. For example, it may set the speed of supply air fan 212 to match the speed of exhaust fan 210. As a result, the rate at which air is removed and supplied to kitchen 102 is approximately equal and thus the temperature and air pressure remains relatively constant. Controller 220 may also set the speed of supply air fan 212 to a speed that is greater than the speed of exhaust fan 210 to create positive pressure in kitchen 102. Additionally or alternatively, controller 220 may set the speed of supply air fan 212 to a speed that is less than the speed of exhaust fan 210 to create negative pressure in kitchen 102. This ensures that the environment in kitchen 102 remains safe and comfortable regardless of how much air is being ventilated through exhaust hood 116.

Exhaust fan 210 and supply air fan 212 may be powered by various types of motors including, but not limited to, AC single-phase electrical motors, AC three-phase electrical motors, and DC electrical motors. The speeds of exhaust fan 210 and supply air fan 212 may be adjusted by controller 220 by modulating the frequency of the output of a variable frequency drive in the case of AC single-phase or three-phase electrical motors, by a phase cut modulation technique in the case of a single-phase motor, or by changing voltage in case of a DC electrical motor.

Modifications, additions, or omissions may be made to autonomous ventilation system 200 and the described components. As an example, while FIG. 2 depicts one piece of cooking equipment 114 and one spillage zone 216, autonomous ventilation system 200 may be modified to include any number and combination of these items. Additionally, while certain embodiments have been described in detail, numerous changes, substitutions, variations, alterations and modifications may be ascertained by those skilled in the art. For example, while autonomous ventilation systems 200 has been described in reference to kitchen 102 and cooking equipment 114, certain embodiments may be utilized in other facilities where ventilation is needed. Such facilities include manufacturing facilities, industrial facilities, residential kitchens, and the like. It is intended that the present disclosure encompass all such changes, substitutions, variations, alterations and modifications as falling within the spirit and scope of the appended claims.

Figures 3A, 3B:
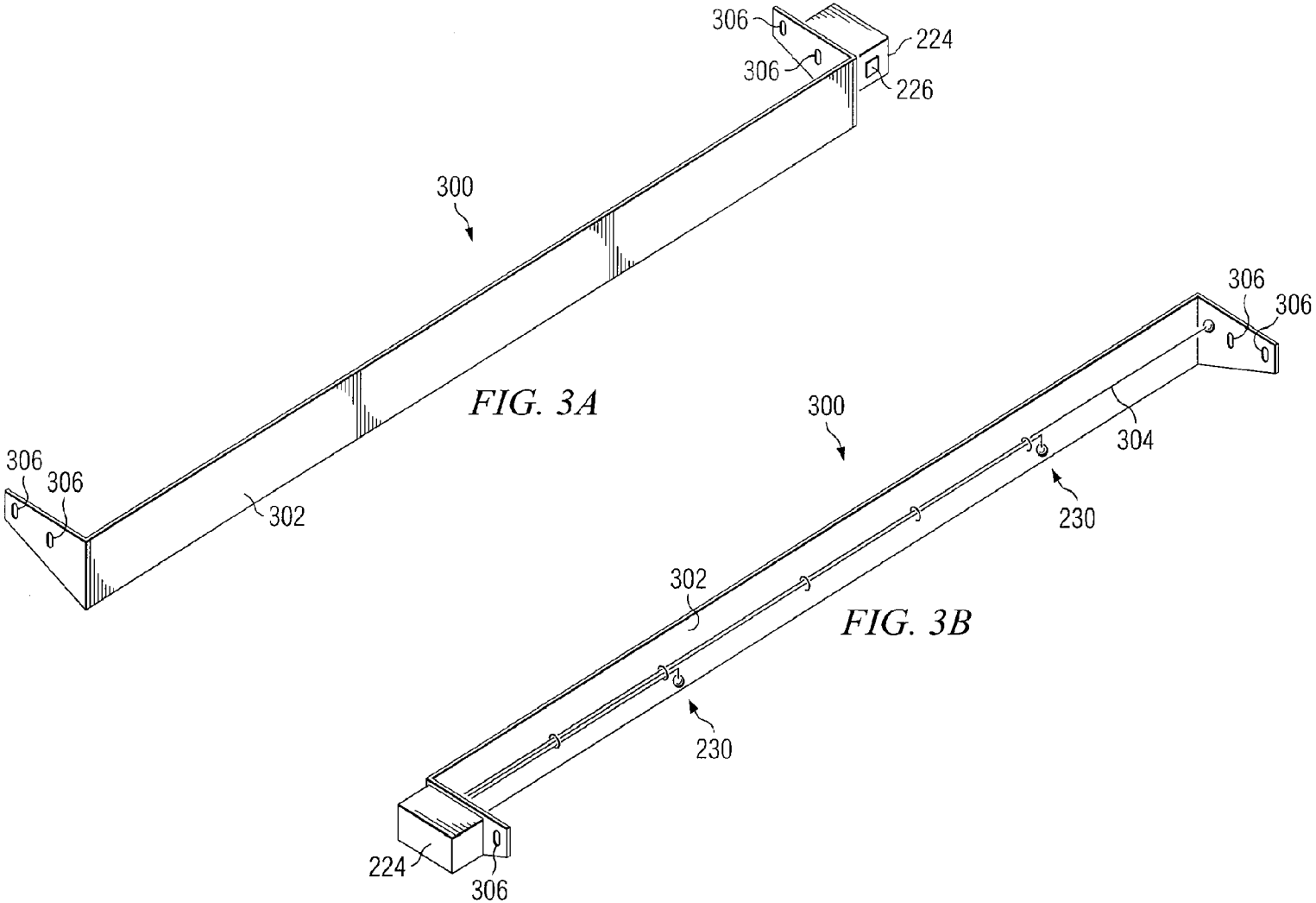
FIGS. 3A and 3B are various views of a spillage probe assembly in accordance with a particular embodiment.

FIGS. 3A and 3B depict an example spillage probe assembly 300, which could be utilized as spillage probe assembly 214, discussed above in connection with FIGS. 2A and 2B. FIG. 3A provides a front view of spillage probe assembly 300, and FIG. 3B provides a back view of spillage probe assembly 300.

Spillage probe assembly 300 includes a housing 302, a tensioned cable 304, one or more spillage sensors 230, a termination box 224, and an override button 226. The one or more spillage sensors 230 and override button 226 are coupled to termination box 224, which may in turn be coupled to controller 220 (not pictured). Tensioned cable 304 is coupled to housing 302 and provides support to spillage sensors 230. Tensioned cable 304 suspends spillage sensors 230 in spillage zone 216 and isolates them from housing 302. Spillage sensors 230 are attached to tensioned cable 304 in such a way that allows a user to slide the sensors on tensioned cable 304 to a location that is above a piece of equipment such as cooking equipment 114 below exhaust hood 116. Tensioned cable 304 may be any material including, but not limited to, metal and/or plastic. In some embodiments, tensioned cable 304 may be replaced with any other suitable means of supporting spillage sensors 230 and isolating them from housing 302.

In operation, spillage probe assembly 300 is mounted to exhaust hood 116 in a manner that allows spillage sensors 230 to monitor spillage zone 216. Spillage probe assembly 300 is mounted to exhaust hood 116 with fasteners via mounting holes 306. Once mounted in the appropriate position above a piece of equipment such as cooking equipment 114, a user may manually adjust the position of one or more spillage sensors 230 by sliding them along tensioned cable 304 so that they are located over the piece of equipment to be monitored. Once in the desired position, spillage sensors 230 communicate information relating to detected changes in environmental parameters in spillage zone 216 to controller 220. For example, if the ventilation rate of autonomous ventilation system 200 is insufficient to capture and remove all air contaminants 122 associated with the operation of cooking equipment 114, spillage air contaminants will spill out of exhaust hood 116 and pass through spillage zone 216. Spillage sensors 230 may detect spillage air contaminants in a manner as described above in reference to FIGS. 2A and 2B and communicate the information to controller 220. Controller 220 may then automatically adjust the speed of exhaust fan 210 and thus the ventilation rate of the autonomous ventilation system.

Modifications, additions, or omissions may be made to spillage probe assembly 300 and the described components. As an example, spillage probe assembly 300 as seen in FIG. 3B includes two spillage sensors 230. It should be noted, however, that spillage probe assembly 300 may include any number of spillage sensors 230. Also, FIG. 3A depicts override button 226 coupled to termination box 224. Override button 226, however, may be coupled to spillage probe assembly 300 in another location, or any location on autonomous ventilation system 200 that is accessible to the user. Additionally, while certain embodiments have been described in detail, numerous changes, substitutions, variations, alterations and modifications may be ascertained by those skilled in the art, and it is intended that the present disclosure encompass all such changes, substitutions, variations, alterations and modifications as falling within the spirit and scope of the appended claims.

Figure 4:
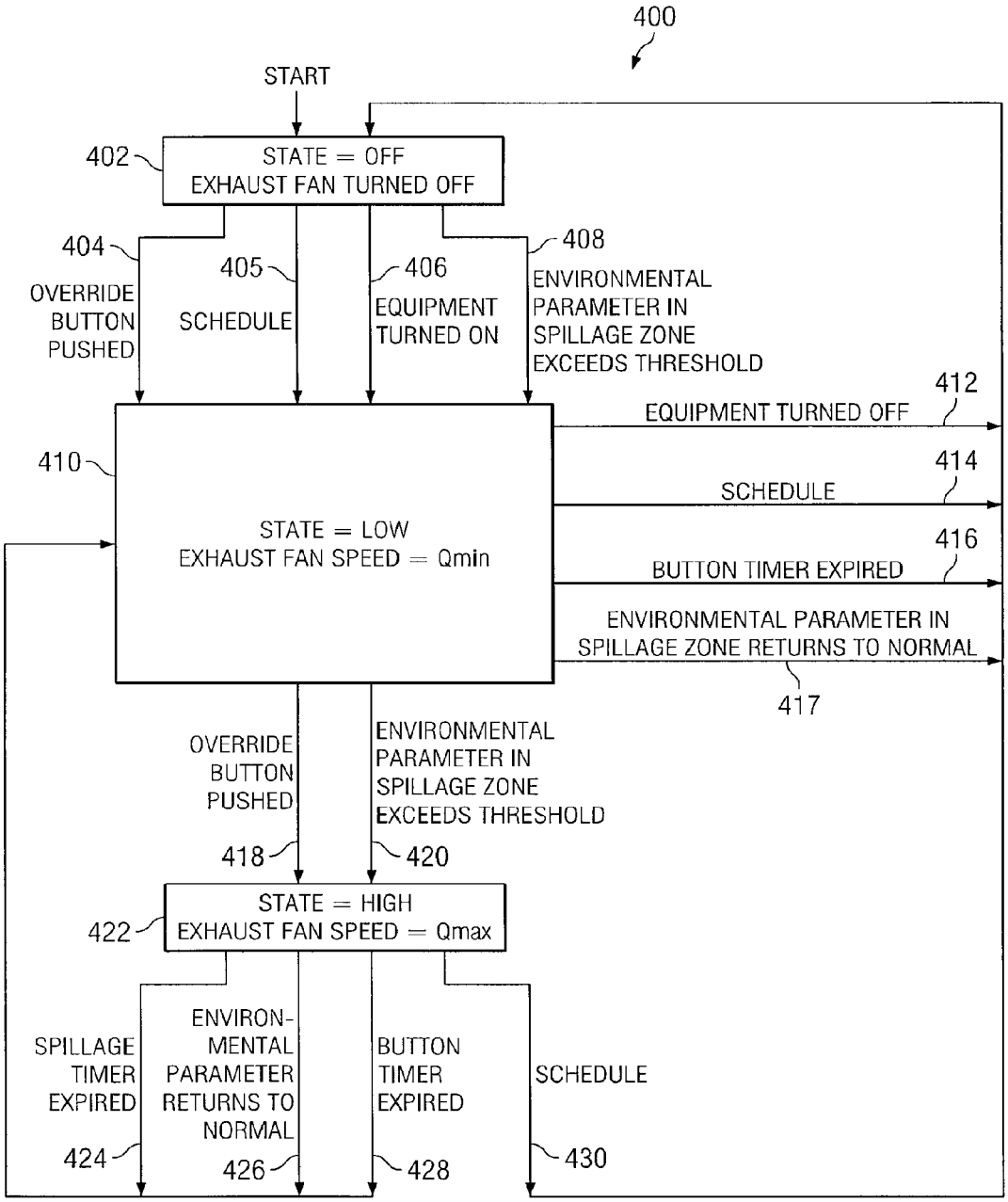
FIG. 4 is a method of controlling a ventilation system in accordance with a particular embodiment.

With reference now to FIG. 4, an example autonomous ventilation control method 400 is provided. Autonomous ventilation control method 400 may be implemented, for example, by controller 220 described in reference to autonomous ventilation system 200 in FIGS. 2A and 2B above. Autonomous ventilation control method 400 will now be described in reference to controller 220 as utilized by autonomous ventilation system 200 in kitchen 102. It must be noted, however, that autonomous ventilation control method 400 may be utilized by any controller to control a ventilation system regardless of location.

Autonomous ventilation control method 400 comprises three main states: OFF, LOW, and HIGH. In OFF state 402, controller 220 turns off exhaust fan 210 where it is not ventilating air from kitchen 102 via exhaust hood 116.

In LOW state 410, controller 220 sets the speed of exhaust fan 210 to a minimal speed, Qmin, as will be described in more detail below. In HIGH state 422, controller 220 sets the speed of exhaust fan 210 to a maximum speed, Qmax.

Autonomous ventilation control method 400 begins in OFF state 402. While in OFF state 402, exhaust fan 210 is turned off. However, autonomous ventilation control method 400 will transition to LOW state 410, where the speed of exhaust fan 210 is set to minimum speed Qmin, if various events occur. Such events may include event 404 where a user presses override button 226, event 405 where a scheduled start time arrives, event 406 where cooking equipment 114 is turned on, or event 408 where an environmental parameter in spillage zone 216 meets or exceeds a predetermined threshold. Conversely, autonomous ventilation control method 400 will transition from LOW state 410 to OFF state 402 if other events occur. These events include event 412 where cooking equipment 114 is turned off, event 414 where a scheduled stop time arrives, event 416 where a period of time elapses after a user pushes override button 226, and/or event 417 where when the environmental parameter in spillage zone 216 returns to normal.

In event 404, a user pushes override button 226 while autonomous ventilation control method 400 is in OFF state 402 and exhaust fan 210 is off. Override button 226 is provided to give the user manual control of autonomous ventilation system 200. When the user presses override button 226 while exhaust fan 210 is off, autonomous ventilation control method 400 will transition to LOW state 410 in order to turn on exhaust fan 210 and ventilate the area. In some embodiments, a timer is started when the user pushes override button 226 in event 404. In event 416, this override button timer expires according to a predetermined, but configurable, amount of time and autonomous ventilation control method 400 transitions from LOW state 410 back to OFF state 402. By monitoring the activity of override button 226, autonomous ventilation control method 400 provides the user a manual means by which to control autonomous ventilation system 200.

In event 405, a predetermined scheduled start time arrives. A user may interface with controller 220 to establish scheduled times for autonomous ventilation system 200 to turn on. Predetermined start times may also be preprogrammed into autonomous ventilation system 200. When a scheduled start time arrives in event 405, autonomous ventilation control method 400 will transition from OFF state 402 to LOW state 410 in order to turn on exhaust fan 210 and set its speed to Qmin. Conversely, a user may interface with controller 220 to establish scheduled times for autonomous ventilation system 200 to turn off, and/or stop times may be preprogrammed into autonomous ventilation system 200. In event 414, a scheduled stop time arrives while autonomous ventilation control method 400 is in LOW state 410. If event 414 occurs, autonomous ventilation control method 400 will transition to OFF state 402 where exhaust fan 210 is set to off.

In event 406, cooking equipment 114 below exhaust hood 116 is turned on while autonomous ventilation control method 400 is in OFF state 402 and exhaust fan 210 is off. If autonomous ventilation control method 400 determines that cooking equipment 114 has been turned on but exhaust fan 210 is off, it will transition to LOW state 410 and set the speed of exhaust fan 210 to Qmin. Conversely, event 412 occurs when cooking equipment 114 below exhaust hood 116 is turned off while autonomous ventilation control method 400 is in LOW state 410. If autonomous ventilation control method 400 determines that event 412 has occurred, it will transition from LOW state 410 to OFF state 402 and turn off exhaust fan 210.

In event 408, an environmental parameter in spillage zone 216 meets or exceeds a predetermined threshold while autonomous ventilation control method 400 is in OFF state 402. Autonomous ventilation control method 400 may determine by communicating with one or more spillage sensors 230 that an environmental parameter in spillage zone 216 has changed sufficiently to warrant the activation of exhaust fan 210. Such environmental parameters may include temperature and airflow as previously described in reference to FIGS. 2A and 2B above. If, for example, spillage sensors 230 are temperature sensors, event 408 would occur when the temperature of spillage zone 216 exceeds that of kitchen 102 by a predetermined, but configurable, amount. If autonomous ventilation control method 400 determines that this event has occurred while it is in OFF state 402, it will transition to LOW state 410 and set the speed of exhaust fan 210 to Qmin. Conversely, event 417 occurs when autonomous ventilation control method 400 is in LOW state 410 and the environmental parameter in spillage zone 216 returns to normal. If autonomous ventilation control method 400 determines that event 417 has occurred, it will transition back to OFF state 402 and turn off exhaust fan 210.

Autonomous ventilation control method 400 also includes HIGH state 422. While in HIGH state 422, exhaust fan 210 is set to its maximum speed, Qmax. Autonomous ventilation control method 400 will transition to HIGH state 422 from LOW state 410 when various events occur. Such events include event 418 where a user presses override button 226, and event 420 where an environmental parameter in spillage zone 216 meets or exceeds a predetermined threshold. Conversely, autonomous ventilation control method 400 will transition from HIGH state 422 to LOW state 410 and set the speed of exhaust fan 210 to Qmin if other events occur. Such events include event 424 where a period of time elapses after an environmental parameter in spillage zone exceeds a threshold, event 426 where an environmental parameter in spillage zone returns to normal, and/or a period of time elapses after a user pushes override button 226 in event 428. Similarly, autonomous ventilation control method 400 will transition from HIGH state 422 to OFF state 410 if a scheduled stop time arrives in event 430.

In event 418, a user pushes override button 226 while autonomous ventilation control method 400 is in LOW state 410 and exhaust fan 210 is set to Qmin. When a user presses override button 226 while exhaust fan 210 is already set to Qmin, autonomous ventilation control method 400 will transition to HIGH state 422 in order to set exhaust fan 210 to its maximum rate Qmax and ventilate the area. In some embodiments, a timer is started when the user pushes override button 226 in event 418. In event 428, this override button timer expires according to a predetermined, but configurable, amount of time and autonomous ventilation control method 400 transitions from HIGH state 410 back to LOW state 410. By monitoring the activity of override button 226, autonomous ventilation control method 400 provides the user a manual means by which to control autonomous ventilation system 200.

In event 420, an environmental parameter in spillage zone 216 meets or exceeds a predetermined threshold while autonomous ventilation control method 400 is in LOW state 410. If, for example, spillage sensors 230 are comprised of temperature sensors, event 420 will occur when autonomous ventilation control method 400 determines that the temperature of spillage zone 216 exceeds that of kitchen 102 by a predetermined amount. If autonomous ventilation control method 400 determines that this event has occurred while it is in LOW state 410, it will transition to HIGH state 422 and set the speed of exhaust fan 210 to Qmax. In some embodiments, this transition from Qmin to Qmax may be instantaneous. In other embodiments, however, the transition may be gradual and/or stair-stepped and may not actually reach Qmax if conditions in spillage zone 216 return to normal during the transition.

Conversely, event 426 occurs when autonomous ventilation control method 400 is in HIGH state 422 and the environmental parameter in spillage zone 216 returns to normal. If autonomous ventilation control method 400 determines that event 426 has occurred, it will transition back to LOW state 410 and set the speed of exhaust fan 210 to Qmin. In some embodiments, autonomous ventilation control method 400 may set a timer after an environmental parameter in spillage zone 216 meets or exceeds a predetermined threshold in event 420. In event 424, this spillage timer expires according to a predetermined, but configurable, amount of time. If autonomous ventilation control method 400 determines that this timer has expired in event 424, it may then transition from HIGH state 422 back to LOW state 410 and set the speed of exhaust fan 210 back to Qmin.

In event 430, a predetermined scheduled stop time arrives in a similar manner as event 414. When a scheduled stop time arrives in event 430, ventilation control method 400 will transition from HIGH state 422 to OFF state 402 in order to turn off exhaust fan 210.

The minimal speed, Qmin, for exhaust fan 210 may be determined by various methods. Initially, Qmin may be preprogrammed to be the lowest capable speed of exhaust fan 210, or it may be a speed that is calculated to provide the minimal amount of ventilation as required by applicable standards. However, Qmin may be automatically adjusted by autonomous ventilation control method 400. For example, if the temperature of spillage zone 216 exceeds that of kitchen 102 by a predetermined amount in event 420, autonomous ventilation control method 400 may gradually increase the speed of exhaust fan 210 from Qmin. It may continually monitor the temperature of spillage zone 216 while it is increasing the speed to determine the speed at which the difference in temperature drops to an acceptable level. It may then record this speed as the new Qmin and use it whenever it is in LOW state 410. In addition or alternatively, a user may initiate a recalibration of Qmin through a local or remote interface while all cooking equipment 114 under exhaust hood 116 is idle. In this procedure, autonomous ventilation control method 400 gradually decreases the speed of exhaust fan 210 from Qmax until the temperature in spillage zone 216 begins to rise. It may then record the speed of exhaust fan 210 at the point the temperature started rising and use it as the new Qmin.

The speed Qmax of exhaust fan 210 is the maximum operating speed of the fan. This speed may be predetermined and/or preset by the manufacturer. In some embodiments, Qmax may be controlled/set by a user through a local or remote interface.

While a particular autonomous ventilation control method 400 has been described, it should be noted that certain steps may be rearranged, modified, or eliminated where appropriate. Additionally, while certain embodiments have been described in detail, numerous changes, substitutions, variations, alterations and modifications may be ascertained by those skilled in the art, and it is intended that the present disclosure encompass all such changes, substitutions, variations, alterations and modifications as falling within the spirit and scope of the appended claims.

What is claimed is:

1. An autonomous ventilation system comprising:

a variable-speed exhaust fan operable to remove an air contaminant from an area;

a controller coupled to the variable-speed exhaust fan and operable to adjust the speed of the exhaust fan;

an exhaust hood coupled to the exhaust fan, the exhaust hood operable to direct the air contaminant to the exhaust fan; and a spillage probe assembly adjacent to an edge of the exhaust hood, the spillage probe assembly including:

an open housing that attaches the spillage probe assembly to the exhaust hood having a first side and a second opposite side attached to the exhaust hood and a third side connected to the first and second sides distal the exhaust hood, the open housing being constructed so as to allow air escaping the exhaust hood to pass through at least a portion thereof;

a spillage sensor arranged within a spillage zone, which is adjacent to the exhaust hood and at or above said edge of the exhaust hood, the spillage sensor being configured to detect a change in an environmental parameter in the spillage zone due to the air escaping the exhaust hood and to communicate information relating to detected changes in the environmental parameter to the controller; and a sensor support extending between the first and second sides that couples the spillage sensor to the open housing, the sensor support being configured such that the spillage sensor can be slidably repositioned along the housing, wherein the controller is further operable to adjust the speed of the fan in response to information relating to changes in the environmental parameter detected by the spillage sensor.

2. The system of claim 1, further comprising an ambient temperature sensor disposed in said area and remote from the exhaust hood, wherein the spillage sensor is a temperature sensor, the environmental parameter is a temperature in the spillage zone, and the controller is configured to control the exhaust fan speed responsively to a difference between the temperature detected by the spillage sensor and a temperature detected by the ambient temperature sensor.

3. The system of claim 1, wherein the spillage sensor is an air flow rate sensor arranged in the spillage zone to measure air flow rate in a vertical direction, and the environmental parameter is air flow rate in the vertical direction.

4. The system of claim 1, wherein the open housing includes a panel facing the exhaust hood and the spillage sensor is arranged between said panel and the exhaust hood.

5. The system of claim 1, further comprising a variable speed supply fan coupled to the controller and operable to deliver air to said area, wherein the controller is configured to control the supply fan responsively to the speed of the exhaust fan.

6. The system of claim 1, wherein said sensor support includes a tensioned cable, and the spillage sensor slides along the tensioned cable for repositioning.

7. The system of claim 1, wherein the spillage probe assembly further includes a second spillage sensor, and said sensor support suspends both of the spillage sensors from the open housing such that each spillage sensor can be slidably repositioned along the open housing independent of each other and such that each spillage sensor is isolated from the open housing.

8. The system of claim 1, wherein the spillage probe assembly further includes an over-ride unit coupled to the controller and configured to provide manual control of the speed of the exhaust fan.

9. A method of ventilating an area comprising:

providing a controller coupled to a variable-speed exhaust fan, the variable-speed exhaust fan having an associated exhaust hood and being operable to remove an air contaminant from an area;

providing a spillage probe assembly adjacent to an edge of the exhaust hood, the spillage probe assembly including:

an open housing that attaches the spillage probe assembly to the exhaust hood having a first side and a second opposite side attached to the exhaust hood and a third side connected to the first and second sides distal the exhaust hood, the open housing being constructed so as to allow air escaping the exhaust hood to pass through at least a portion thereof;

a spillage sensor arranged within a spillage zone, which is adjacent to the exhaust hood and at or above said edge of the exhaust hood, the spillage sensor being coupled to the controller; and a sensor support extending between the first and second sides that couples the spillage sensor to the open housing, the sensor support being configured such that the spillage sensor can be slidably repositioned along the housing;

sensing a change in an environmental parameter in the spillage zone due to the air escaping the exhaust hood using the spillage sensor; and adjusting the speed of the variable-speed exhaust fan using the controller based on the environmental parameter change sensed by the spillage sensor in the spillage zone.

10. The method of claim 9, wherein: an ambient temperature sensor is provided in said area and remote from the exhaust hood, the spillage sensor is a temperature sensor, the environmental parameter is a temperature in the spillage zone, and said adjusting the exhaust fan speed includes controlling the exhaust fan speed responsively to a difference between the temperature detected by the spillage sensor and a temperature detected by the ambient temperature sensor.

11. The method of claim 9, wherein the spillage sensor is an air flow rate sensor arranged in the spillage zone to measure air flow rate in a vertical direction, and the environmental parameter is air flow rate in the vertical direction.

12. The method of claim 9, wherein the providing a spillage probe assembly includes positioning the third side of the open housing such that the spillage sensor is arranged between said third side and the exhaust hood.

13. The method of claim 9, wherein a variable speed supply fan is coupled to the controller and operable to deliver air to said area, and further comprising adjusting a speed of the supply fan using the controller responsively to the speed of the exhaust fan.

14. The method of claim 9, wherein said sensor support includes a tensioned cable, and further comprising repositioning the spillage sensor by sliding the sensor along the tensioned cable.

15. The method of claim 9, wherein the spillage probe assembly further includes a second spillage sensor, and said sensor support suspends both of the spillage sensors from the open housing such that each spillage sensor can be slidably repositioned along the open housing independent of each other and such that each spillage sensor is isolated from the open housing.

16. The method of claim 9, wherein the spillage probe assembly includes an over-ride unit coupled to the controller and configured to provide manual control of the speed of the exhaust fan.

* * * * *